US008826967B1

(12) United States Patent
Hunter

(10) Patent No.: US 8,826,967 B1
(45) Date of Patent: Sep. 9, 2014

(54) LINEAR MOTION SAND MOLDING MACHINE

(71) Applicant: William Gary Hunter, Barrington, IL (US)

(72) Inventor: William Gary Hunter, Barrington, IL (US)

(73) Assignee: Hunter Foundry Machinery Corporation, Schaumburg, IL (US)

( * ) Notice: Subject to any disclaimer, the term of this patent is extended or adjusted under 35 U.S.C. 154(b) by 0 days.

(21) Appl. No.: 13/837,939

(22) Filed: Mar. 15, 2013

(51) Int. Cl.
*B22C 15/00* (2006.01)
*B22C 21/00* (2006.01)
*B22C 11/00* (2006.01)

(52) U.S. Cl.
CPC ..... *B22C 11/00* (2013.01)
USPC ..... 164/169; 164/385; 164/388

(58) Field of Classification Search
USPC ..... 164/169, 187, 374–393
See application file for complete search history.

(56) References Cited

U.S. PATENT DOCUMENTS

| | | | |
|---|---|---|---|
| 3,406,738 | A | 10/1968 | Hunter |
| 3,506,058 | A | 4/1970 | Hunter |
| 4,699,199 | A | 10/1987 | Hunter |
| 4,840,218 | A | 6/1989 | Hunter |
| 4,890,664 | A | 1/1990 | Hunter |
| 6,622,772 | B1 | 9/2003 | Hunter |
| 7,210,515 | B2 | 5/2007 | Hunter |

OTHER PUBLICATIONS

Aircel A208WS Centrifugal Water Separator, www.ecompressedair.com/filtration/centrifugal-separators (printed Feb. 19, 2013).
Threaded Line Vac, www.exair.com (printed Feb. 19, 2013).
Cyclonic separation, http://en.wikipedia.org/wiki/Cyclonic_separation (printed Feb. 19, 2013).

*Primary Examiner* — Kevin P Kerns
*Assistant Examiner* — Steven Ha
(74) *Attorney, Agent, or Firm* — Pauley Petersen & Erickson

(57) ABSTRACT

An automated matchplate molding machine includes a cope flask, a pattern plate and a drag flask for creating formed sand molds. The mold machine incorporates linear-motion slides and/or rodless cylinders to move the cope flask, drag flask, sand hopper, and/or other components of the mold machine.

20 Claims, 5 Drawing Sheets

LINEAR MOTION SAND MOLDING MACHINE

FIELD OF THE INVENTION

The present invention generally relates to automated matchplate molding machines for forming sand molds for use in foundries, and more particularly relates to apparatus in such mold making equipment for filling and stabilizing drag flasks and/or cope flasks.

BACKGROUND OF THE INVENTION

Foundries use automated matchplate molding machines for forming sand molds. Formed sand molds are subsequently filled with molten metal material, cooled, and then broken apart to release metal castings. There are several prior art systems for this purpose including several prior art systems assigned to the present Assignee, Hunter Automated Machinery Corporation, including U.S. Pat. No. 3,406,738 to Hunter; U.S. Pat. No. 3,506,058 to Hunter; U.S. Pat. No. 4,890,664 to Hunter; U.S. Pat. No. 4,699,199 to Hunter; U.S. Pat. No. 4,840,218 to Hunter; U.S. Pat. No. 6,622,772 to Hunter; and U.S. Pat. No. 7,210,515 to Hunter. The entire disclosures of these patent references are hereby incorporated by reference as the present invention may be incorporated or used in these types of molding systems. Additional reference can be had to these patent references for additional details of the state of the art and to see potential applicability of the present invention. While the foregoing inventions have set forth significant advances and advanced the state-of-art to increase the speed and efficiency in which automated sand molding can occur, there is still further room for improvement in automated molding machinery which is the subject of the present invention.

SUMMARY OF THE INVENTION

A general object of the invention is to provide an improved molding machine for forming molds from sand. Exemplary molding devices according to this invention include a support frame, a cope flask for making cope molds, a drag flask for making drag molds, and a pattern plate adapted to be positioned between the cope flask and the drag flask, and typically fixed to the drag flask, for forming patterns in the cope and drag molds. The mold machines include a squeeze station with a squeeze head being received at an open end of the cope flask. The squeeze station includes expandable and retractable actuators, such as pneumatic or hydraulic pistons, mounted between the cope and drag flask and the support frame to drive the cope and drag flask relative to the squeeze head. The molding machine further includes a drag flask filling station horizontally adjacent to the squeeze station. The drag flask is cyclically shifted back and forth between the squeeze station and the drag flask filling station during operation of the molding machine. A hopper car having a sand measuring hopper with a sand discharge outlet is disposed movable above the support frame to add sand to the cope and drag flasks to create the sand molds.

The molding machine support frame according to this invention can include vertical cylindrical frame legs at the squeeze station, and the cope flask is movably mounted on each of the cylindrical frame legs by a cylindrical linear-motion slide. In a similar manner the mold machine squeeze station includes a platen table assembly driven by a hydraulic actuator, wherein the platen table is elevated and carries a drag flask, pattern plate, and mold in contact with a bottom surface of the cope flask and mold in the operational state such that as the drag flask, pattern plate, and cope flask are driven toward the squeeze head, and that is movably mounted on each of the cylindrical frame legs by a cylindrical linear-motion slide. Each cylindrical linear-motion slide can include a cylindrical housing enclosing a cylindrical bearing that extends around an outer circumference of the corresponding vertical frame leg.

In one or more embodiments of this invention, the hopper car shifts horizontally relative to the support frame via one or more linear-motion slides, between the squeeze station for filling the cope flask with sand and the drag flask filling station for filling the drag flask with sand. Each linear-motion slide can include a cylindrical shaft mounted on the support frame or hopper car, and a linear-motion bearing slidably mounted about the cylindrical shaft. The linear-motion bearing is disposed in a bearing housing that is connected to the hopper car or support frame. The linear-motion slide(s) can include a compensation mechanism that allows displacement caused by the movement of the squeeze head to contact upper frame stops of the compensation mechanism during the mold making operation.

The molding machine can include a rotary cradle in the filling station that receives and holds the drag flask during filling. A board feeder can be disposed adjacent the rotary cradle to insert a bottom board over the filled drag flask. In one or more embodiments of this invention, the board feeder including one or more rodless cylinders connected to the support frame for moving the bottom board with respect to the rotary cradle. Each rodless cylinder is desirably pivotally mounted to a board feeder head plate of the board feeder. The board feeder can include a board feeder head plate pivotally mounted on a carriage of the rodless cylinder, such as by a bearing between the board feeder head plate and the carriage. The carriage can be magnetically coupled to a piston that moves within a corresponding cylinder of the rodless cylinder.

In one or more embodiments of the invention, the molding machine includes a spray head, such as for applying a release agent to the pattern plate, disposed in the filling station, and a spray vapor evacuation device disposed adjacent to at least one of the rotary cradle or the spray head. The spray head can include a spray nozzle oriented toward the rotary cradle for spraying the release agent on the pattern plate as it comes into the rotary cradle, and the evacuation device is desirably disposed in or around a spray area between the spray head and the rotary cradle. The evacuation device can include a tube connected to a vacuum source, such as an inline vacuum pump in combination with the evacuation tube. A separation device including at least one of a cyclonic separator or a water separator can also be used in combination with the tube to separate some or all of the captured release agent vapor from the air in the tube. In one embodiment of the invention, the evacuation device additionally or alternatively includes a tube end in combination with a gap formed between an inner plate of the drag flask and the pattern plate, such as for collecting spray vapors near the point of intended contact with the pattern plate.

DETAILED DESCRIPTION OF THE INVENTION

Figure 1:
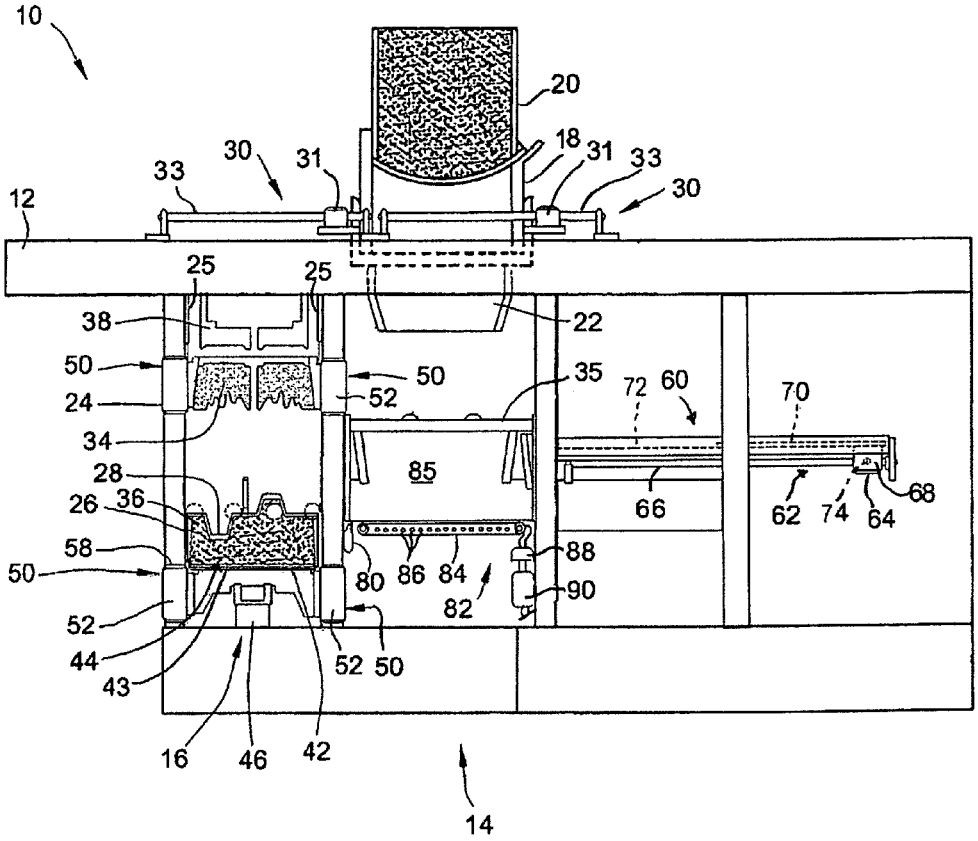
FIG. 1 is a partly schematic representation of a molding machine illustrating an embodiment of the invention.

FIG. 1 generally illustrates an automatic matchplate molding machine according to one embodiment of this invention. Machines of these types are well known to those of ordinary skill in the art and are widely used throughout the foundry industry. In view of the fact that many of the details of different types of molding machines or other such machines are known and also shown generally in the aforementioned patents which have been incorporated by reference, discussion of the general operation of the machine will thus be limited and particular focus will be given to the particular inventive improvements to the machine which are discussed and claimed herein.

Figure 2:
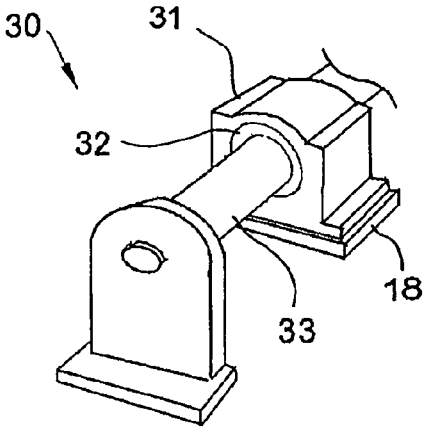
FIGS. 2-5 illustrate particular aspects of the molding machine of FIG. 1.

As shown in FIG. 1, the molding machine 10 includes a support frame 12. Different sections of the support frame 12 provide for different work stations including a drag flask filling station 14 and a mold squeeze and release station 16. The molding machine 10 includes a movable hopper car 18 which includes a sand measuring hopper 20 that is filled with sand. The sand measuring hopper 20 has an openable and closable discharge port 22 which is adapted to align with and discharge sand separately into a cope flask 24 and a drag flask 26. In the particular embodiment of FIG. 1, the movable hopper car 18 is attached to the frame by linear slides 30. As shown in FIGS. 1 and 2, Each linear slide 30 includes a bearing housing 31 connected, for example by bolts and/or welds, to the hopper car 18, and enclosing a linear-motion bearing 32. The bearing can be any suitable linear-motion bearing. The bearing moves along cylindrical shaft 33, which is attached, by bolts and/or welds, to frame 12. Any suitable type, size, and configuration of linear-motion slide and/or bearing is suitable for use between the hopper car 18 and the frame 12.

The hopper car 18 linearly reciprocates horizontally along a top portion of the support frame 12, such as by pneumatic or hydraulic pistons, mechanical chain drives, and/or rodless cylinders separate or integral to the linear slides 30. The hopper car 18 automatically shifts back and forth between the mold squeeze and release station 16 and the drag flask filling station 14. This alternately and successively positions the sand hopper 20 at the mold squeeze and release station 16 to fill the cope flask 24 and the drag flask filling station 14 to fill the drag flask 26. The cope flask 24 is always situated at the mold squeeze and release station 16 during all successive molding operations of the machine 10, while the drag flask 26 (and pattern plate 28 which is typically secured thereto) is carted back and forth between the two stations 14, 16. To facilitate the horizontal cycling back and forth between the two stations, rollers 29 are provided upon which the drag flask 26 is adapted to ride and roll between the two stations.

At the drag flask filling station 14, the drag flask 26 is received in a rotary cradle 35 that flips the drag flask 26 upside down such that the open end 44 of the drag flask 26 faces the discharge port 22 of the sand hopper 20 allowing the drag flask 26 to be filled with sand. After the drag flask 26 is filled with sand it can then be turned over again by the rotary cradle 35 to an upright position and then shifted to the mold squeeze and release station 16, where it is assembled with the cope flask. The cope flask 24 is lowered into position by one or more actuators 25 connected between the frame 12 and the cope flask 24. Once in position, the cope flask 24 is then filled with sand, squeezed, and then disassembled to release the formed cope and drag molds 34, 36. Formed molds 34, 36 are then output to downstream mold handling equipment for receipt of molten metal to produce metal castings.

The mold squeeze and release station 16 includes several relatively conventional components including a squeeze head 38 that is adapted to be received in an open end 40 of the cope flask and a platen table 42 which receives a bottom board 43 of the drag flask 44. As shown, the squeeze head 38 and platen table 42 are arranged in opposition relative to each other with sufficient space provided therebetween to receive the mold flask assembly for the formation of sand molds. Preferably the plunging axis is vertically aligned as shown, with the platen table 42 located vertically underneath the squeeze head 38. The platen table 42 is actuated by a platen hydraulic cylinder 46 which is operable to raise and lower the platen table 42. The hydraulic cylinder 46 is also operable to squeeze the cope and drag molds 34, 36 contained in the cope and drag flasks 24, 26 when the flask assembly is assembled to form and compress the cope and drag molds 34, 36. The hydraulic cylinder 46 is also operable to locate the platen table 42 at different elevations to facilitate release of the drag mold 36 and assemblage of the formed drag mold 36 with the cope mold 34.

Figure 3:
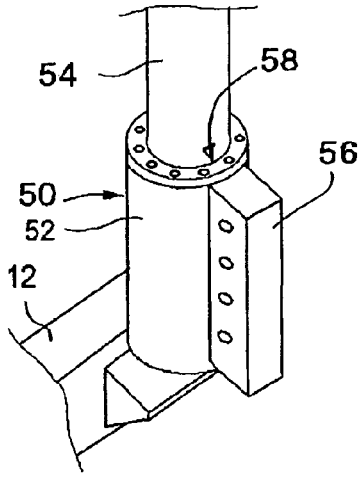

In one embodiment of this invention, the cope flask 24 and/or the drag flask 26, such as via the platen table 42 and/or hydraulic cylinder assembly, is supported on the frame 12 by linear-motion slides 50, such as shown in FIG. 3. The linear-motion slides 50 each includes a generally cylindrical bearing housing 52 enclosing a cylindrical linear bearing that wraps around and travels on one of the vertical, cylindrical frame legs 54 of the frame 12. Cylindrical frame legs 54, like shafts 33, are desirably made of a suitable linear-motion material such as stainless steel. The bearings can be formed of any suitable material, such as stainless steel and/or composite plastic. The cylindrical shape of the bearings, and the extension of the cylindrical bearings around the legs 54, provides additional support to the squeeze station 16 during operation, and under the pressure exerted on the molds in the squeeze chamber 16.

As shown in FIG. 3, the cylindrical bearing housing 52 includes an attachment extension 56 for connecting to the corresponding cope flask 24 or drag flask support, such as by bolts and/or welds. The slides 50 can include an optional wiper assembly 58, such as a flexible ring in contact with the leg 54, on each end of the bearing to reduce or eliminate contamination of the bearing with dust or sand fines that can accumulate on the vertical leg 54. As will be appreciated by those skilled in the art following the teachings herein provided, various sizes, shapes, and configurations are available for the linear-motion slides, and the corresponding bearings and other components, depending on need and the particular molding machine configuration.

FIG. 1 shows the drag flask 26 filled with sand and within the squeeze station 16. During sand filling, the drag flask 26 is positioned within the filling station 14. The drag flask 26 is attached to the pattern plate 28 and inverted by the rotary cradle 35 to position the pattern plate 28 in the downward position to receive sand thereon. The hopper car 18 is positioned as shown in FIG. 1 to fill the drag flask 26 with sand. After filling, a bottom board 43 is moved over the drag flask open end 44 from a board feeder 60. The bottom board 43 allows the rotary cradle to invert the filled drag flask 26 for moving to the squeeze station 16.

Figure 4:
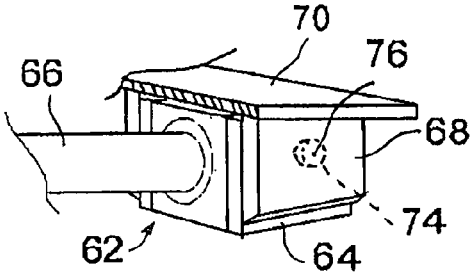

In one embodiment of this invention, the board feeder 60 includes one or more rodless cylinders 62 for moving the bottom board 43. As shown in FIGS. 1 and 4, each rodless cylinder 62 includes a carriage 64 mounted on a hollow cylinder 66. A piston assembly is movably disposed within the cylinder 66, and desirably includes a magnet or other suitable mechanism to couple the inner piston with the outer carriage 64. As compressed air alternatively enters the cylinder at opposing ends, the air pressure moves the piston. The coupling between the piston and the carriage 64 moves the carriage 64 along the outside of the cylinder 66 in concert with the piston movement within the cylinder 66. The use of the rodless cylinder 62 can be used to replace combinations of pneumatic pistons and cam follower bearings, or other equivalent bearings, thereby reducing the number of moving parts, and the need for frequent replacements due to wear of the of these many individual moving parts.

As shown in FIG. 4, the carriage 64 is connected to a cradle extension 68 of a board feeder head plate 70 of the board feeder 60. As the carriage 64 moves back and forth along the cylinder 66, the carriage 64 moves the board feeder head plate 70, which in turn pushes the bottom board 43 along track 72 into position over the upward facing drag flask open end 44, thereby closing open end 44 for transport to the squeeze station 16. In one embodiment of this invention, the cradle 68 of the board feeder head plate 70 is pivotally connected to the carriage 64. When the drag flask 26 is being filled in the filling station 14, extra sand is often deposited on the drag flask 26, thereby making the sand extend over the drag flask top at the open end 44. The bottom board 43 is thus pushed by the board feeder 60 through this excess sand, and the bottom board 43 pushes the excess sand off the drag flask 26. As the bottom board 43 extends through the excess sand, the sand can change the trajectory of the bottom board 43 slightly upward, thereby impart undesirable force on the rodless cylinder(s) 62, and particularly the thin wall of cylinder 66. A pivotal connection of the cradle 68 reduces and/or eliminates the transfer of this upward stress and/or movement to the rodless cylinder(s) 62. In one embodiment, as shown in FIG. 4, the cradle 68 is mounted on the carriage 64 by a bearing 74, with the cradle 68 and the chassis 64 supporting a pin axle 76 of the bearing.

In particular embodiments of the invention, a release agent is applied to the pattern plate 28, such as prior to the drag flask 26 receiving sand. An exemplary release agent is offered under the name FoundaryGeneral® (General Chemical Corp., Brighton, Mich.). The release agent is desirably applied as a spray to the pattern plate 28. As shown in FIG. 1, the mold making machine can include a spray head 80, including one or more nozzles or equivalent structures, for applying the release agent to the pattern plate 28 as or after the pattern plate 28 returns to the filling station 14. In one embodiment of this invention, the mold machine 10 includes a spray vapor evacuation device for reducing or eliminating release agent vapor resulting from the spray head 80. In the embodiment of FIG. 1, the evacuation device 82 is desirably positioned about a portion of the spray area 85, such as adjacent to and/or attached to the rotary cradle 35 and/or the drag flask 26. As shown in the embodiment of FIG. 1, the evacuation device 82 is positioned below the rotary cradle 35, and thus below the drag flask 26 when the drag flask 26 is within the rotary cradle 35. The evacuation device 82 includes a collection tube 84 extending along and/or below at least one side, preferably two sides, and desirably along all four sides of the rotary cradle 35. The collection tube 84 can be any suitable size and material, such as PVC plastic, and includes collection holes 86 therein and facing inward toward the spray area 85. Any suitable number, size, shape, and configuration are available for the collection holes 86.

The collection tube 84 is connected by suitable tubing to a vacuum source 88, which creates a negative pressure in the tube 84, thereby drawing vapor from the spray area 85 into collection tube 84. Any suitable vacuum source or pump can be used as vacuum source 88. In one exemplary embodiment, the vacuum source 88 is or includes an inline vacuum, such as a threaded line vac from Exair (Cincinnati, Ohio). The vacuum source draws the collected vapor and/or fumes into the evacuation device 82, which exhausts the fumes to a desired area or to a collection device 90. The collection device can be a filter and/or other suitable collection or filtration device. In one embodiment of this invention, the collection device 90 is or includes a separation device. Exemplary separation devices include, without limitation a cyclonic separator and/or a water separator, such as a centrifugal water separator. The collection device desirably removes or concentrates the vapor particulate or fumes, thereby reducing or eliminating the vapor or fumes from air exhausted to the environment.

Figure 5:
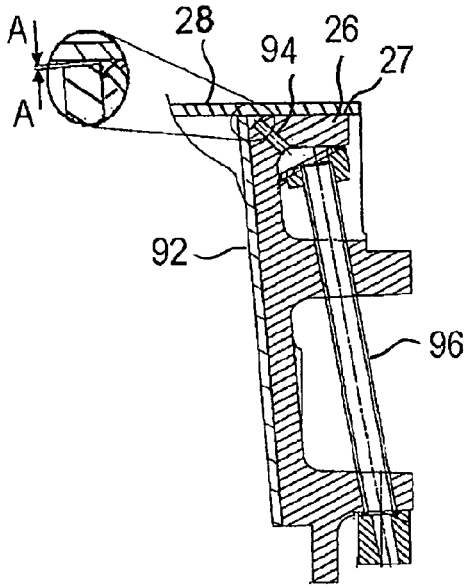

FIG. 5 illustrates an additional or alternative embodiment of the evacuation device, according to one embodiment of this invention. FIG. 5 shows a sectional view of a side of the drag flask 26. Some known embodiments of drag flasks include an inner plate 92 that is spaced offset from an end 27 of the drag flask, such as by a distance A. Distance A is a fraction of an inch, such as about 0.01 to 0.02 inch. The offset provides a small gap between the inner plate 92 and the pattern plate 28, thereby allowing airflow through, for example, tube 94 and thus reducing suction and promoting release of the sand mold from the drag flask 26 in squeeze station 16. In one embodiment of this invention, the evacuation device includes vacuum tube 96 that can create a vacuum pressure through tube 94 and remove spray vapor and/or fumes through the offset gap of inner plate 92. Various and alternative sizes, shapes, and configurations are available for this additional drag flask evacuation device.

Figure 6:
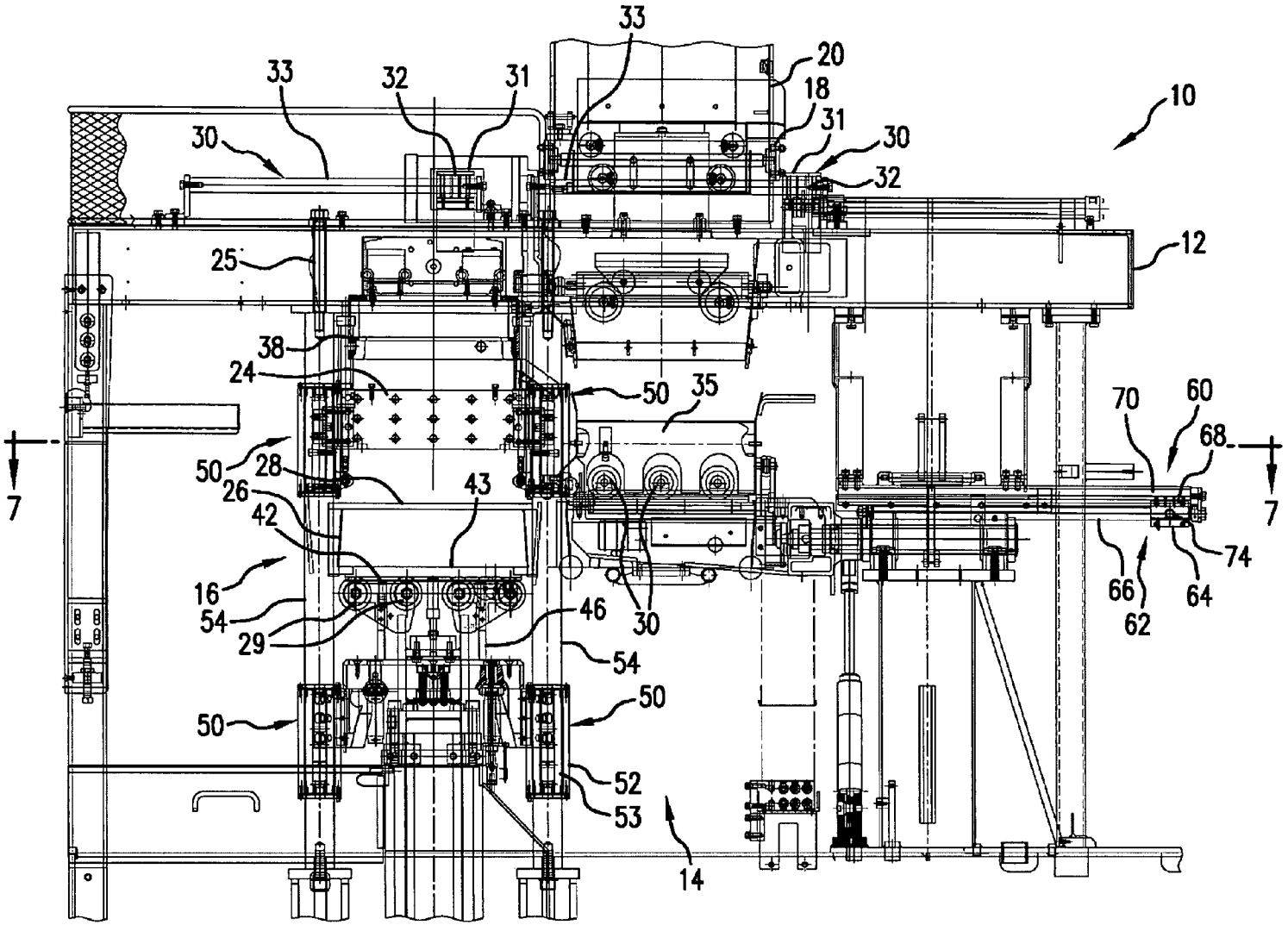
FIGS. 6-8 are schematic drawings of a molding machine according to an embodiment of the invention.
Figure 7:
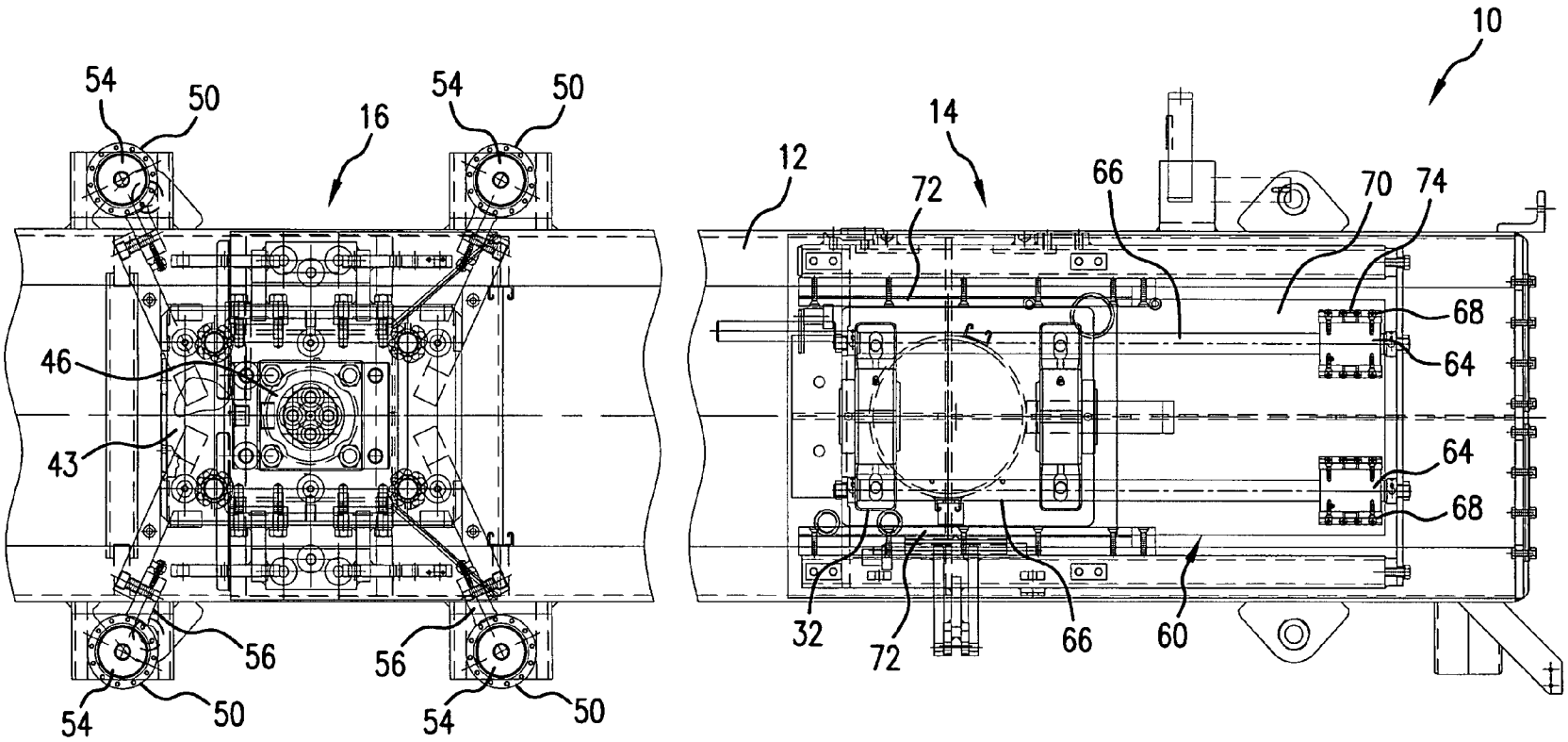
Figure 8:
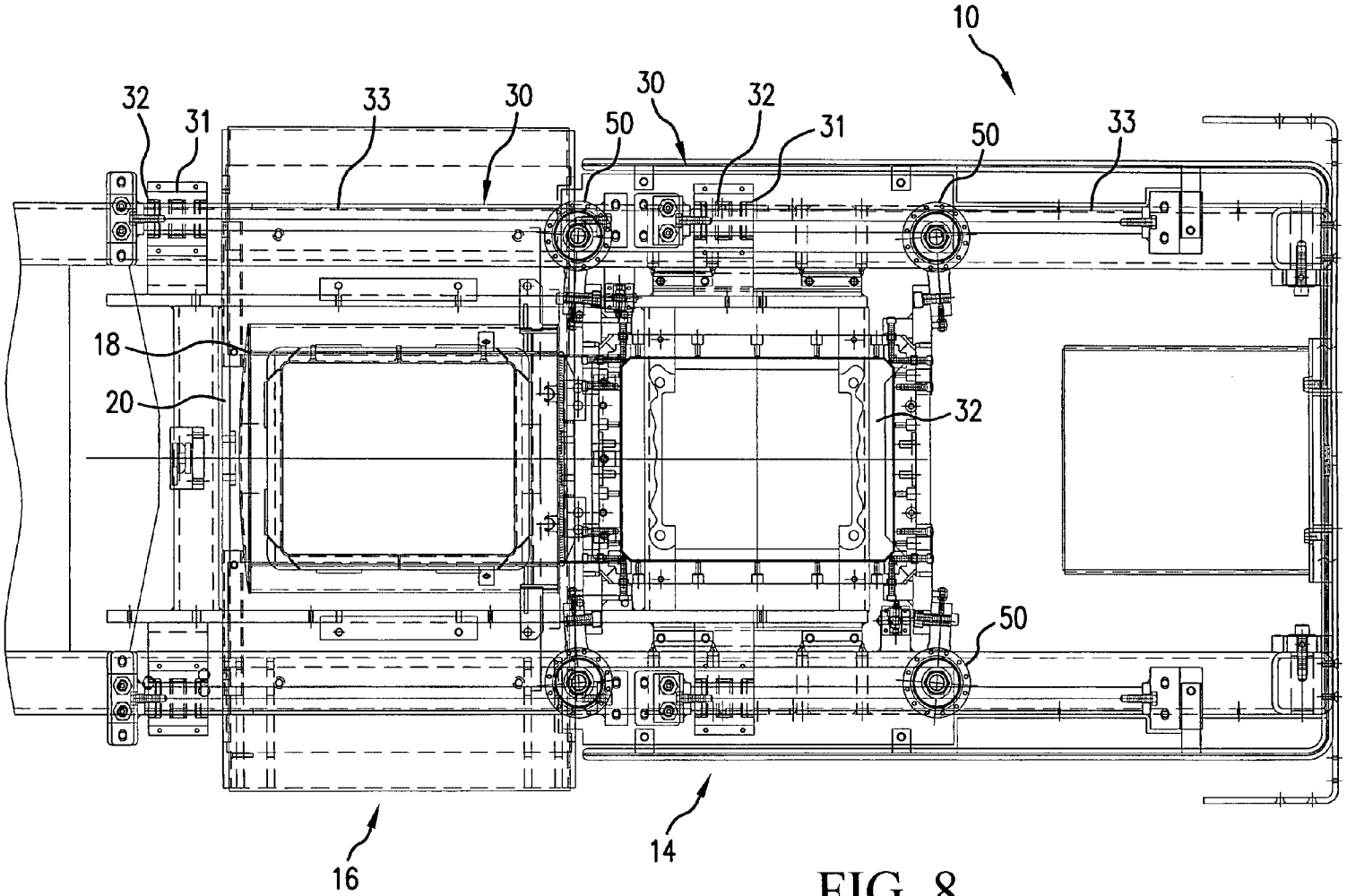

FIGS. 6-8 are schematic drawings of a molding machine 10 according to an embodiment of the invention. FIG. 6 is a lateral view of the molding machine 10, FIG. 7 is a sectional view across line 7-7 in FIG. 6, and FIG. 8 is a partial top view of the molding machine 10.

The molding machine 10 includes a support frame 12, defining, at least in part, a drag flask filling station 14 and a mold squeeze and release station 16. The molding machine 10 includes a movable hopper car 18 which includes a sand hopper 20 that is filled with sand. The sand hopper 20 has an openable and closable discharge port 22 which is adapted to align with and discharge sand separately into a cope flask 24 and a drag flask 26. The movable hopper car 18 is attached to the frame by linear slides 30. Each linear slide 30 includes a bearing housing 31 connected to the hopper car 18, and enclosing a linear-motion bearing 32. The bearing moves along cylindrical shaft 33, which is attached to frame 12.

At the drag flask filling station 14, the drag flask 26 is received in a rotary cradle 35 that flips the drag flask 26 upside down, allowing the drag flask 26 to be filled with sand. After the drag flask 26 is filled with sand it can then be turned over again by the rotary cradle 35 to an upright position and then shifted to the mold squeeze and release station 16, via rollers 29, where it is assembled with the cope flask 24. The cope flask 24 is lowered into position by one or more actuators 25 connected between the frame 12 and the cope flask 24.

The mold squeeze and release station 16 includes a squeeze head 38 that is adapted to be received in an open end 40 of the cope flask and a platen table 42 which receives a bottom board 43 of the drag flask 44. The platen table 42 is actuated by a platen hydraulic cylinder 46 which is operable to raise and lower the platen table 42. Each of the cope flask 24 and the platen table 42 assembly is supported on the frame 12 by linear-motion slides 50. The linear-motion slides 50 each includes a generally cylindrical bearing housing 52 enclosing a cylindrical linear bearing that wraps around and travels on one of the vertical, stainless steel, cylindrical frame legs 54 of the frame 12.

During sand filling, the drag flask 26 is positioned within the filling station 14. The drag flask 26 is attached to the pattern plate 28 and inverted by the rotary cradle 35 to position the pattern plate 28 in the downward position to receive sand thereon. The hopper car 18 is positioned as shown in FIG. 6 to fill the drag flask 26 with sand. After filling the platen 43, also referred to as a bottom board, is moved along track 72 over the drag flask open end 44 from the board feeder 60. The platen 43 allows the rotary cradle to invert the filled drag flask 26 for moving to the squeeze station 16.

The board feeder 60 includes one or more rodless cylinders 62 for moving the bottom board 43. As shown in FIGS. 6 and 7, each rodless cylinder 62 includes a carriage 64 mounted on a hollow cylinder 66. The carriage 64 is connected to a cradle extension 68 of the board feeder head plate 70 of the board feeder 60. As the carriage 64 moves back and forth along the cylinder 66, the carriage 64 moves the board feeder head plate 70, which in turn pushes the bottom board 43 along track 72 into position over the upward facing drag flask open end 44, thereby closing open end 44 for transport to the squeeze station 16. The cradle 68 of the board feeder head plate 70 is pivotally connected to the carriage 64 by a bearing 74.

Thus, the invention a mold machine having improved linear component movement. The invention reduces moving parts, such as through the use of linear bearings and/or rodless cylinders, and provides a vapor evacuation device that improves operator conditions.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A molding machine for forming molds from sand, comprising:

a support frame;

a cope flask for making cope molds;

a drag flask for making drag molds;

a pattern plate adapted to be positioned between the cope flask and the drag flask for forming patterns in the cope and drag molds;

a squeeze station including a squeeze head being received at an open end of the cope flask containing a cope mold;

at least one actuator mounted to each of the cope flask and the support frame, the actuator being expandable and retractable to drive the cope flask relative to the squeeze head;

a drag flask filling station horizontally adjacent the squeeze station, the drag flask filling station including a rotary cradle adapted to rotate the drag flask;

a spray head disposed in the filling station; and a spray vapor evacuation device disposed adjacent to at least one of the rotary cradle or the spray head.

2. The molding machine of claim 1, wherein the support frame comprises vertical cylindrical frame legs at the squeeze station, and the cope flask is movably mounted on each of the cylindrical frame legs by a cylindrical linear-motion slide.

3. The molding machine of claim 2, further comprising:

a platen table driven by a hydraulic actuator, wherein the platen table is elevated and carries a drag mold in contact with a bottom surface of the cope mold in an operational state, wherein the platen table is movably mounted on each of the cylindrical frame legs by a cylindrical linear-motion slide.

4. The molding machine of claim 3, wherein each cylindrical linear-motion slide includes a cylindrical housing enclosing a cylindrical bearing extending around an outer circumference of the corresponding vertical frame leg.

5. The molding machine of claim 1, further comprising a drag flask filling station horizontally adjacent the squeeze station, the drag flask being cyclically shifted back and forth between the squeeze station and the drag flask filling station during operation of the molding machine, and a hopper car having a sand hopper with a sand discharge outlet, the hopper car shifting horizontally via a linear-motion slide between the squeeze station for filling the cope flask with sand and the drag flask filling station for filling the drag flask with sand.

6. The molding machine of claim 5, wherein the linear-motion slide includes a cylindrical shaft mounted on the support frame and a linear-motion bearing slidably mounted about the cylindrical shaft, the linear-motion bearing disposed in a bearing housing that is connected to the hopper car.

7. The molding machine of claim 1, further comprising:

a rotary cradle receiving the drag flask during filling; and a board feeder adjacent the rotary cradle and adapted to insert a bottom board over the drag flask, the board feeder including a rodless cylinder connected to the support frame.

8. The molding machine of claim 7, wherein the rodless cylinder is pivotally mounted to a board feeder head plate of the board feeder.

9. The molding machine of claim 7, wherein the board feeder includes a feeder head plate pivotally mounted on a carriage of the rodless cylinder.

10. The molding machine of claim 9, wherein the feeder head plate is mounted on the carriage by a bearing.

11. The molding machine of claim 1, wherein the spray head includes a nozzle oriented toward the rotary cradle, and the evacuation device is disposed in or around a spray area between the spray head and the rotary cradle.

12. The molding machine of claim 1, wherein the evacuation device comprises a tube connected to a vacuum source.

13. The molding machine of claim 12, wherein the vacuum source is an inline vacuum pump in combination with the evacuation tube.

14. The molding machine of claim 12, further comprising a separation device including at least one of a cyclonic separator or a water separator, in combination with the tube.

15. The molding machine of claim 12, wherein the tube ends in combination with a gap formed between an inner plate of the drag flask and the pattern plate.

16. The molding machine of claim 1, wherein the evacuation device is disposed below the rotary cradle.

17. The molding machine of claim 1, wherein the evacuation device comprises a threaded line vacuum.

18. The molding machine of claim 1, wherein the evacuation device is disposed about a portion of a spray area.

19. The molding machine of claim 18, wherein the evacuation device comprises a plurality of collection holes.

20. The molding machine of claim 19, wherein the collection holes face inward toward the spray area.

* * * * *